United States Patent [19]

Porter

[11] Patent Number: 4,480,729

[45] Date of Patent: Nov. 6, 1984

[54] ANTI-SURGE VALVE FOR HYDRAULIC LOCKING DEVICE

[75] Inventor: Clyde R. Porter, Los Angeles, Calif.

[73] Assignee: P. L. Porter Company, Woodland Hills, Calif.

[21] Appl. No.: 81,398

[22] Filed: Oct. 3, 1979

[51] Int. Cl.[3] ..... F16F 9/34

[52] U.S. Cl. ..... 188/300; 137/498; 137/504; 137/853; 138/43; 138/45; 138/46

[58] Field of Search ..... 188/280, 300; 137/498, 137/504, 517, 853, 859; 138/43, 45, 46

[56] References Cited

U.S. PATENT DOCUMENTS

| | | | |
|---|---|---|---|
| 2,917,075 | 12/1959 | Terry | 137/504 |
| 2,939,487 | 6/1960 | Fraser et al. | 137/517 |
| 2,950,733 | 8/1960 | Perkins | 137/504 |
| 3,477,464 | 11/1969 | Ryan | 137/517 |
| 3,828,651 | 8/1974 | Dorner et al. | 188/300 |
| 3,860,098 | 1/1975 | Porter et al. | 188/300 |

*Primary Examiner*—George E. A. Halvosa
*Attorney, Agent, or Firm*—Beehler, Pavitt, Siegemund, Jagger & Martella

[57] ABSTRACT

An anti-surge valve for installation in a cylindrical chamber permits a fluid to flow at low velocity into and out of a port that opens into the cylindrical chamber and is located on the concave wall of the cylindrical chamber, the valve preventing a high velocity flow of the fluid from the cylindrical chamber into the port. The valve includes a sealing tube that is positioned within the cylindrical chamber in juxtaposition with the port and coaxial with but spaced radially inward from the portions of the concave wall that surround the port. The sealing tube is maintained in this position by spacers surrounding the sealing tube and extending radially outwardly to the inner surface of the cylindrical chamber. The anti-surge valve is a unitary structure molded of rubber. The sealing tube is sufficiently stiff that at low flow velocities the sealing tube is not drawn toward the concave wall sufficiently to interfere with low velocity flow, but the sealing tube is sufficiently flexible that at high flow velocities, the sealing tube is drawn against the portion of the concave wall that surrounds the port, thereby sealing the port and preventing high velocity flow of the fluid from the cylindrical chamber into the port.

10 Claims, 2 Drawing Figures

ANTI-SURGE VALVE FOR HYDRAULIC LOCKING DEVICE

BACKGROUND OF THE INVENTION

1. Field of the Invention

The present invention is in the field of hydraulics, and more specifically relates to hydraulic positioning devices of a locking type, which typically are used to control the tilt of seat backs in aircraft.

2. The Prior Art

The anti-surge valve of the present invention is an improvement for use in hydraulic locking devices such as those described in U.S. Pat. No. 3,380,561 issued to C. R. Porter, and U.S. Pat. No. 4,155,433 issued to C. R. Porter, both patents being assigned to P. L. Porter Company, the assignee of the present invention.

Hydraulic locking devices of this type include a moveable piston which separates two working chambers in a cylinder. The working chambers are normally filled to capacity with a hydraulic fluid, and movement of the piston is made possible by a selectively-enabled flow of fluid through a passage extending through the piston. A pressurized fluid reservoir supplies a small compensation flow into and out of the working chambers to compensate for changes in the total volume of fluid in the chambers due to leakage or thermal expansion. The compensation flow is enabled only when the piston is near one end of its stroke, and the compensation flow velocity is relatively slow because the reservoir is not highly pressurized.

Normally, one end of the hydraulic locking device is attached to a stationary member, and the other end of the hydraulic locking device is attached to a moveable structure which is to be selectively locked at a chosen position. In a typical application, the moveable structure is an arm connected to the tiltable back of a seat. When the seat back is pushed forward, the hydraulic locking device is extended in length.

Such devices include a control pushbutton connected to a control rod which opens a valve enabling flow through the piston, and no problems are encountered with this mode of operation. However, the embodiments of the hydraulic locking device with which the present invention is concerned further include means for operating in an override mode, wherein, when the seat back is pushed forward, pressure produced in one of the working chambers unseats the spring-loaded ball valve within the piston enabling flow of fluid through the piston even though the control pushbutton has not been actuated.

As the hydraulic locking device is being thus extended in the override mode, the pressure rises substantially and rapidly in the working chamber whose volume is being reduced, because of the viscosity of the fluid and the relatively small cross section of the flow passages through the piston. Near the end of the expansion stroke, a bleed orifice in the piston rod which communicates with the chamber whose volume is being reduced, arrives at the port in the cylinder wall that leads to the pressurized reservoir. The pressure in the reservoir is not as great as the transient pressure in the working chamber. When the bleed orifice becomes aligned with the port in the cylinder wall, the high transient pressure in the bleed orifice drives fluid into the reservoir, displacing the spring-loaded reservoir seal.

Because fluid is displaced into the reservoir instead of into the chamber whose volume is being increased, the total volume of fluid remaining in the working chambers is no longer equal to the total volume of the space of the working chambers. This results in a vacuum space being formed in the chamber whose volume is being increased. This vacuum space manifests itself as backlash or play of the seat back, i.e., inability of the hydraulic device to hold a definite position, with the result that the seat back can freely be moved within a small interval.

In addition to resulting in sloppy positioning of the seat back, the surge of high-pressure fluid into the reservoir displaces the spring-loaded reservoir seal, causing excessive wear of the seal.

Thus, the need was recognized for some means of preventing the high-pressure, high-velocity surge of fluid into the reservoir without interfering with the normal low-velocity compensation flow into and out of the reservoir.

SUMMARY OF THE INVENTION

The present invention solves the long-standing problem described above by providing an anti-surge valve for use in certain embodiments of hydraulic locking devices. In those embodiments of the hydraulic locking device with which the present invention is intended to function, the compensation flow passes from the reservoir, and into a bleed orifice or passage through a cylinder wall terminating at a port on the concave inner surface of a cylindrical chamber which in turn communicates with the high-pressure working chamber.

In a preferred embodiment, the anti-surge valve is a unitary tube-like article of a resilient material which is positioned within the cylindrical chamber radially inwardly of the port. The outside diameter of the anti-surge valve is slightly less than the inside diameter of the cylindrical chamber. In a preferred embodiment, the tube-like anti-surge valve is supported by a flange extending circumferentially around one end of the valve so as to keep the anti-surge valve coaxial with the cylindrical chamber.

The walls of the anti-surge valve are sufficiently stiff that they are practically unaffected by low flow velocities, but at the high flow velocities which characterize the high pressure surge discussed above, the anti-surge valve is drawn against the portions of the concave wall that surround the port, so as to seal the port to prevent high-velocity flow from entering the port and passing through the bleed orifice to the reservoir. The anti-surge valve of the present invention thus prevents high-velocity flow into the reservoir, but does not noticeably interfere with low-velocity compensatory flow into and out of the reservoir to compensate for changes in the volume of fluid in the working chambers.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
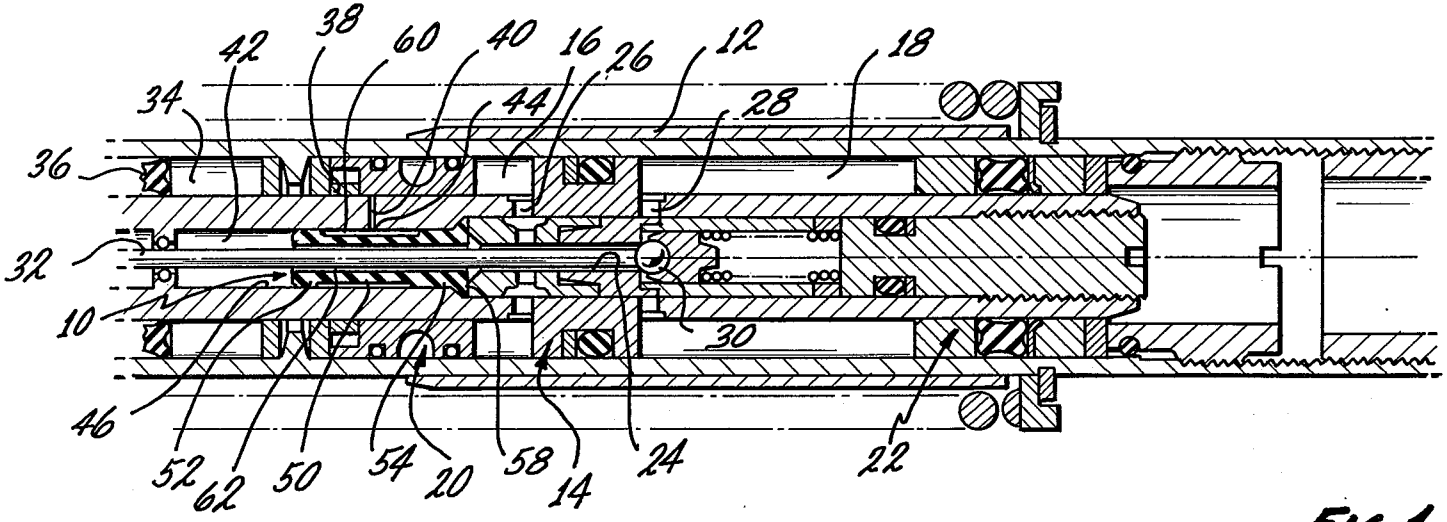
FIG. 1 is a fractional cross-sectional view of a hydraulic locking device showing the anti-surge valve of the present invention installed in the hydraulic locking device; and, FIG. 2 is a perspective view of a preferred embodiment of the anti-surge valve of the present invention.

Turning now to the drawings, FIG. 1 shows a preferred embodiment of the anti-surge valve 10 of the present invention installed in a typical hydraulic locking device. Hydraulic locking devices of this type, but lacking the anti-surge valve of the present invention, have been known in the art for some time, and are described in the U.S. patents referred to above, which are incorporated herein by reference. For this reason, the hydraulic locking device will not be described in great detail, but instead only those features pertinent to the present invention will be described.

Typically, the hydraulic locking device, as shown in FIG. 1, includes an outer cylinder 12 within which a piston 14 is mounted for axial motion. The piston 14 separates the space within the outer, cylinder 12 into two working chambers 16, 18, which are sealed at their outer ends by the glands 20, 22, respectively. The working chambers 16, 18 are normally completely filled with hydraulic fluid, and movement of the piston 14 is enabled by a flow of fluid through the piston 14 by way of the passages 24, 26, and 28. Taken together, the passages 24, 26, 28 interconnect the chambers 16, 18, but this interconnection is realized only when the ball valve 30 is unseated. In a normal mode, unseating of the ball valve 30 is accomplished by the operator's moving the control rod 32 to the right in FIG. 1. In the override mode, the ball valve 30 is unseated when a high pressure in the working chamber 16 is applied to the left side of the ball valve 30 as viewed in FIG. 1.

As discussed above, the problem with which the present invention is concerned arises in the override mode. When the seat back is pushed forward in the override mode, i.e., without actuating the control rod 32, the piston 14 is pulled to the left as viewed in FIG. 1, tending to decrease the volume of the working chamber 16 and to increase the volume of the working chamber 18. Movement of the piston 14 is facilitated by the flow of hydraulic fluid from the working chamber 16 through the passages 24, 26, 28 into the working chamber 18. Because these passages are relatively small, and in view of the viscosity of the hydraulic fluid, a high-pressure surge is produced in the working chamber 16 when the seat back is pushed forward, particularly if the motion is rather rapid. The high-pressure surge in the working chamber 16 would not in itself be harmful, and the problem arises only because of the way in which the high-pressure surge affects the mechanism included in the hydraulic locking device by means of which the total volume of hydraulic fluid in the working chambers 16, 18 is compensated, by the addition or withdrawal of hydraulic fluid, for volumetric changes caused by temperature fluctuations and leakage.

The fluid compensation system of the hydraulic locking device includes the reservoir 34 which is pressurized by a spring-loaded piston 36, by the slipper seal 38, by the bleed orifice 40 which opens into the cylindrical chamber 42 at the port 44 and by the passage 24. This system is described in the patents referred to above, and an extensive discussion will not be given here. The fluid compensation system is actuated only when the piston 14 has been drawn to its extreme leftward position as viewed in FIG. 1. At this position, the bleed orifice 40 is juxtaposed with the slipper seal 38 and is thereby placed in communication with the pressurized reservoir 34". Fluid from the reservoir 34 may then flow into the working chambers for replenishment purposes through the bleed orifice 40, into the cylindrical chamber 42, through the passage 24 and the passages 26, 28 into the working chambers 16, 18. It is also possible, with the piston in its extreme leftward position, for excessive fluid in the working chambers 16, 18 to be bled back into the reservoir 34 to relieve thermal expansion.

The next three paragraphs describe in detail the problem which the present invention solves. It will be understood that the anti-surge valve 10 is to be regarded as absent from FIG. 1 for purposes of describing the problem that is solved by installing it.

When the seat back was pushed forward rapidly to its extreme position, thereby creating a pressure surge in the working chamber 16, as the piston neared the leftward end of its stroke, the high pressure in the working chamber 16 was transmitted through the cylindrical chamber 42 and the bleed orifice 40 to cause fluid to surge into the reservoir 34. This surge of fluid into the reservoir reduced the total volume of fluid in the working chambers 16, 18, and specifically resulted in the formation of a vacuum void space in the working chamber 18. As the piston 14 remained in its most leftward position, the pressure in the reservoir 34 and in the high-pressure working chamber 16 reached equilibrium, but the equilibrium pressure was not sufficiently great to open the ball valve 30 to permit replenishment of the working chamber 18 from the reservoir 34, and so the void remained in the working chamber 18, and this permitted free travel of the piston to the right, which manifested itself as "play" or "backlash" in the positioning of the seat back at all future times. It was found, however, that if the control rod 32 were actuated as or after the seat back was pushed forward, the void in the working chamber 18 was relieved by the normal compensation flow from the reservoir 34. More often than not, aircraft crews did not actuate the control rod 32 because it was not convenient to do so.

Thus, the problem was to find some way of preventing the high pressure surge from the cylindrical chamber 42 from flowing through the port 44 into the bleed orifice passage 40 and thereby into the reservoir 34, without interfering with the normal operation of the fluid compensation system of the locking device in which a low-pressure compensation flow of fluid into and out of the chamber 42 to the port 44 is a normal and essential occurrence.

The inventor was generally aware that anti-surge valves had been built, but these were understood to be large and complex units consisting of many parts and intended for use in industrial pipelines. Such units would be a hundred times the size of the anti-surge valve of the present invention, wherein the diameter of the cylindrical chamber 42 is typically 0.168 inches, and were therefore deemed irrelevant to the solution of the present problem. Further, it appeared to be necessary to install the anti-surge valve in the cylindrical chamber 42 of the hydraulic locking device, which is traversed by the axially-extending control rod 32. This unusual-shaped available space, as well as the desirability of using as few parts as possible in the anti-surge valve further compounded the problem. It was by no means clear that a simple anti-surge valve could be conceived which would fit into the space between the control rod 32 and the concave wall 46 of the cylindrical chamber 42.

Figure 2:
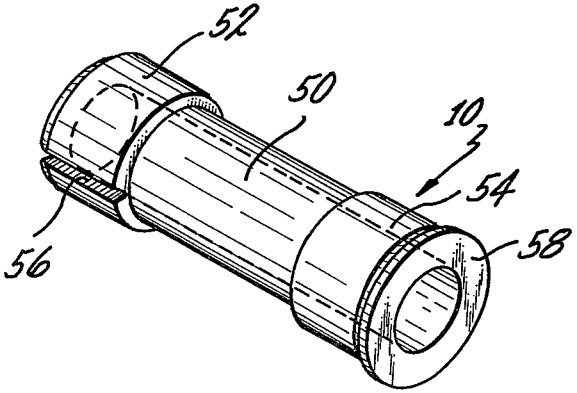

At length, it was found that the anti-surve valve 10 shown installed in the hydraulic locking device in FIG. 1 and shown in perspective view in FIG. 2, would solve the above-described problem. As can be seen from the drawings, the anti-surge valve 10 is a unitary structure molded of a resilient elastomeric substance such as buna N rubber in a preferred embodiment, and therefore the anti-surge valve 10 is both simple and inexpensive.

In the preferred embodiment of the anti-surge valve shown in the FIGS. 1 and 2, the anti-surge valve 10 includes a sealing tube 50 of cylindrical form whose outer diameter is slightly less than the inside diameter of the cylindrical chamber 42. The anti-surge valve 10 is maintained in coaxial alignment with the cylindrical chamber 42 by means of the flanges 52, 54, located at the ends of the sealing tube 50. The flanges 52, 54 are sized to extend radially from the outer cylindrical surface of the sealing tube 50 to the inner wall 46 of the cylindrical chamber 42. The flange 52 is provided with a groove 56 which extends in the axial direction from one end to the other of the flange 52. Movement of the anti-surge valve axially leftward, as viewed in FIG. 1, is prevented by the provision of the end flange 58.

As mentioned above, in the preferred embodiment, the entire anti-surge valve 10 is a unitary structure consisting of an elastomeric material. In other embodiments, the anti-surge valve 10 may be an assembly in which the flanges 52, 54 are collars which are affixed at the ends of the sealing tube 50; in this alternative embodiment, the collars are composed of a material different from that used for the sealing tube. For example, in the alternative embodiment, the flanges may be metal.

The operation of the fluid compensation system of the hydraulic locking device remains unaffected by the installation of the anti-surge valve into the hydraulic locking device in the manner shown in FIG. 1. For purposes of illustration, it will be assumed that the compensation flow is out of the reservoir to replace hydraulic fluid lost by leakage from the system; it is understood that the direction of flow would be reversed if there was a surplus of fluid in the chambers, to transfer the surplus fluid back into the reservoir. Loss of fluid from the working chambers will result in a reduction of pressure in whichever chamber has lost the fluid, and therefore the higher pressure maintained in the reservoir 34 will cause the flow of fluid from the reservoir to the chamber where the loss of fluid occurred. It will be recalled that the compensation flow is enabled only when the piston is extended fully to the left as viewed in FIG. 1 so that the bleed orifice 40 is brought into communication with the reservoir 34 through the slipper seal 38. The fluid thus flows in sequence from the reservoir 34, through the slipper seal 38, into and through the bleed orifice 40 through the port 44 in the wall 46 of the cylindrical chamber 42 and into the space 60 between the outer surface of the sealing tube 50 and the wall 46 of the cylindrical chamber 42. From thence the fluid flows axially through the groove 56, around the left end of the valve, and into the space 62 between the control rod 32 and the inside wall of the sealing tube 50. The space 62 leads into the passage 24, which in turn opens into the passage 26 and the working chamber 16, and when the ball valve 30 is unseated, into the passage 28 to the working chamber 18. This compensation flow occurs at relatively low velocities because the quantity of fluid is relatively low and the pressure differences therefore are also low.

It is well known from the theory of fluid dynamics that the flow of a fluid over a surface affects the pressure exerted by the fluid on the surface, and the magnitude of the effect generally increases as the velocity increases. For this reason, the pressure on the portion of the outside wall of the sealing tube 50 opposite the port 44 is less than the pressure in the passage 62, since the velocity of the fluid is less in the passage 62. For this reason, even at very low velocities, a force is exerted on the sealing tube urging it toward the port 44. However, because of the relatively low velocity of the compensation flow, the force is extremely weak, and accordingly, the sealing tube 50 is not drawn toward the concave wall 46 sufficiently to diminish substantially the space between the cylindrical outer surface of the sealing tube 50 and the portions of the wall 46 that surround the port 44. Thus, the installation of the anti-surge valve 10 into the hydraulic locking device does not interfere appreciably with the compensation flow. However, a different situation prevails when the seat back is pushed forward rapidly in the override mode of operation of the hydraulic device.

In that case, a high fluid pressure is produced in the working chamber 16, and this pressure is transmitted at the speed of sound through the passage 26, the passages 24 and 62, and into the cylindrical chamber 42, through the groove 56, and into the space 60 causing the fluid in the space 60 immediately to surge into the port 44 and through the bleed orifice 40 to the reservoir 34. The high pressure causes a high velocity flow of the fluid, particularly in the space 60 surrounding the port 44. Accordingly, a much larger force is produced than in the case of the compensation flow, urging the sealing tube 50 toward the port 44. The sealing tube 50 is sufficiently flexible that for the high velocity flow, the cylindrical outer surface of the sealing tube 50 is drawn against the portions of the concave wall 46 that surround the port 44 thereby sealing the port almost immediately, and preventing further flow into the port 44.

Those skilled in the art will recognize that the crucial design problem is to assure that the sealing tube is neither too flexible nor too stiff. In the preferred embodiment and best mode, the inside diameter of the cylindrical chamber 42 is 0.168 inches and the outside diameter of the sealing tube 50 is 0.150 inches in diameter, and the length of the sealing tube between the flanges 52, 54 is 0.312 inches. In this best mode, the anti-surge valve is a unitary structure consisting of buna N rubber.

The anti-surge valve of the present invention solves a longstanding problem in the art in a uniquely simple and efficient manner.

The foregoing detailed description is illustrative of a preferred embodiment of the invention, and it is to be understood that additional embodiments will be obvious to those skilled in the art. The embodiment described herein, together with those additional embodiments, are considered to be within the scope of the invention.

What is claimed is:

1. An anti-surge valve to permit a fluid to flow at low velocity into and out of a port that opens into a cylindrical chamber, the port located on the concave wall that defines the cylindrical chamber, and to prevent a high-velocity flow of the fluid from the cylindrical chamber into the port, said anti-surge valve comprising in combination:

a sealing tube positioned within the cylindrical chamber in juxtaposition with the port and including a cylindrical outer surface coaxial with but spaced radially inward of the portions of the concave wall that surround the port;

spacer means for maintaining the cylindrical outer surface of said sealing tube spaced from the concave wall in the absence of fluid flow to provide a space for the fluid to flow through in passing between the port and the cylindrical chamber, inlet means into said space for producing fluid flow generally parallel to said sealing means, whereby such a flow of fluid causes the cylindrical outer surface of said sealing tube to be urged toward the portions of the concave wall that surround the port by a force related to the velocity of the flow;

said sealing tube consisting of an elastic material and being sufficiently stiff that at low flow velocities said sealing tube is not drawn toward the concave wall sufficiently to diminish substantially the space between said cylindrical outer surface and the portions of the concave wall that surround the port, but being sufficiently flexible that at high flow velocities the cylindrical outer surface of said sealing tube is drawn against the portions of the concave wall that surround the port so as to seal the port to prevent high-velocity flow of the fluid from the cylindrical chamber into the port.

2. The anti-surge valve of claim 1 wherein the anti-surge valve is a unitary structure and wherein said spacer means is a flange surrounding said sealing tube and of sufficient radial thickness to extend radially from the cylindrical outer surface of said sealing tube to the concave wall of the cylindrical chamber.

3. The anti-surge valve of claim 2 wherein said flange further comprises portions defining a groove that extends axially from one end to the other end of said flange in its outer cylindrical surface.

4. The anti-surge valve of claim 2 wherein said flange is located at one end of the cylindrical surface of said sealing means.

5. The anti-surge valve of claim 1 wherein said spacer means further comprise a tubular collar surrounding said sealing tube and of sufficient radial thickness to extend radially from the cylindrical outer surface of said sealing tube to the concave wall of the cylindrical chamber.

6. The anti-surge valve of claim 5 wherein said tubular collar further comprises portions defining a groove that extends axially from one end to the other end of said tubular collar in its outer cylindrical surface.

7. The anti-surge valve of claim 5 wherein said tubular collar is located at one end of the sealing tube.

8. In a hydraulic locking device of the type wherein changes in the total volume of fluid in the working chambers is made up by a low-velocity compensation flow of fluid between a pressurized fluid reservoir and the working chambers, wherein the compensation flow passes through a port that opens into a chamber defined by a wall and communicating with the working chambers, and wherein it is desired to prevent transient high-pressure surges in the working chambers from driving fluid from the working chambers into the fluid reservoir while not interfering with the relatively gradual compensation flow, the improvement comprising in combination:

sealing means positioned within the chamber in juxtaposition with the port and extending parallel to the portions of the wall that surround the port;

spacer means for maintaining said sealing means spaced from the wall in the absence of fluid flow to provide a space for the fluid to flow through in passing between the port and the chamber, inlet means into said space for producing fluid flow generally parallel to said sealing means, whereby such a flow of fluid causes said sealing means to be urged toward the portions of the wall that surround the port by a force related to the velocity of the flow;

said sealing means consisting of an elastic material and being sufficiently stiff that at low flow velocities said sealing means is not drawn toward the wall sufficiently to diminish substantially the space between said sealing means and the wall, but being sufficiently flexible that at high flow velocities said sealing means is drawn against the portions of the wall that surround the port so as to seal the port to prevent high-velocity flow of the fluid from the chamber into the port.

9. The improvement of claim 8 wherein said sealing means and said spacer means are parts of unitary structure.

10. The improvement of claim 8 wherein said anti-surge valve is a unitary structure consisting of an elastomeric material.

* * * * *